US008276615B2

(12) United States Patent
Weber

(10) Patent No.: US 8,276,615 B2
(45) Date of Patent: Oct. 2, 2012

(54) FLUID DELIVERY EXTENSION SYSTEM

(76) Inventor: Taiyo Christian Weber, Christchurch (NZ)

( * ) Notice: Subject to any disclaimer, the term of this patent is extended or adjusted under 35 U.S.C. 154(b) by 303 days.

(21) Appl. No.: 12/797,619

(22) Filed: Jun. 10, 2010

(65) Prior Publication Data

US 2011/0127301 A1 Jun. 2, 2011

(30) Foreign Application Priority Data

Dec. 2, 2009 (NZ) ..... 581572

(51) Int. Cl.
*F16K 11/074* (2006.01)

(52) U.S. Cl. ..... 137/625.46; 137/801; 239/25

(58) Field of Classification Search ..... 137/625.46, 137/801; 4/675–678; 239/25, 27, 499, 505, 239/518, 521

See application file for complete search history.

(56) References Cited

U.S. PATENT DOCUMENTS

| | | | | | |
|---|---|---|---|---|---|
| 799,657 | A | * | 9/1905 | Lambert | 239/25 |
| 1,027,474 | A | * | 5/1912 | Hamrick | 239/25 |
| 1,028,142 | A | * | 6/1912 | Seaman | 239/25 |
| 1,044,648 | A | * | 11/1912 | Hamrick | 239/25 |
| 1,062,786 | A | * | 5/1913 | Miller | 239/33 |
| 1,253,309 | A | | 1/1918 | Ulleland | |
| 1,366,150 | A | * | 1/1921 | Askin | 137/603 |
| 1,799,815 | A | | 4/1931 | Hoff | |
| 1,994,454 | A | * | 3/1935 | Cross | 239/27 |
| 2,171,023 | A | | 8/1939 | Buxton | |
| 2,476,079 | A | | 7/1949 | Benjamin | |
| 2,507,535 | A | | 5/1950 | Madsen | |
| 2,747,930 | A | | 5/1956 | Hyde | |
| 3,079,088 | A | * | 2/1963 | Hermann et al. | 239/25 |
| 3,316,928 | A | | 5/1967 | Weakley | |
| 3,533,554 | A | * | 10/1970 | Mongerson | 239/27 |
| 3,638,968 | A | | 2/1972 | Barks | |
| 3,765,455 | A | | 10/1973 | Countryman | |
| D288,520 | S | | 3/1987 | Bozarth | |
| 4,722,127 | A | * | 2/1988 | Pujol | 29/890.031 |

(Continued)

*Primary Examiner* — John Rivell
*Assistant Examiner* — Matthew W Jellett
(74) *Attorney, Agent, or Firm* — Phillips Ryther & Winchester; Matthew D. Thayne

(57) ABSTRACT

Disclosed are embodiments of apparatus, methods, and systems for fastening a rotatable tube to spigots and nozzles, for fluid-water flow diversion to facilitate the use of sinks by small children. In one embodiment, a tube is provided, which is fastened to a spigot and nozzle. The tube-spigot fastening may be facilitated by a tapered washer. The tube, in turn, may be rotated about the supporting spigot secured to the electronic article. The tube may be configured with curvature, tapering, wall and end openings of sufficient weight, shape, and/or size to allow for optimal water flow choices.

| Patent No | Month/Year | Name |
|---|---|---|
| 2,171,023 | August 1939 | Buxton |
| 1,253,309 | January 1918 | Ulleland |
| 5,349,987 | September 1994 | Shieh |
| 4,736,890 | April 1988 | Wallington |
| 2,476,079 | February 1947 | Benjamin |
| 5,072,757 | December 1991 | Lin |
| 2,507,535 | May 1950 | Madsen |
| 5,758,690 | June 1998 | Humpert et al |
| U.S. Pat. No. 6,179,130 B1 | January 2001 | Nguyen et al |
| 6,381,770 B1 | May 2002 | Raisch |
| 1,799,815 | April 1931 | Hoff |
| 6,085,790 | July 2001 | Humpert et al |
| 5,833,849 | November 1998 | Primdahl |
| 3,765,455 | October 1973 | Countryman |
| 5,983,938 | November 1999 | Bowers et al |
| U.S. 2007/0176024 A1 | August 2007 | Denzler |
| 5,165,121 | November 1992 | McTargett et al |
| U.S. Pat. No. 6,367,707 B1 | April 2002 | Kang |
| 2,747,930 | May 1956 | Hyde |
| U.S. Pat. No. 6,648,187 B1 | November 2003 | Shypkowski |
| 3,316,928 | May 1967 | Weakley |
| D288520 | March 1987 | Bozarth |
| U.S. 2006/0207670 A1 | September 2006 | Peters |
| U.S. Pat. No. 6,425,149 B1 | July 2002 | Wang |
| 3,638,968 | February 1972 | Barks |
| U.S. 2007/0175531 A1 | August 2007 | Daniels |
| U.S. Pat. No. 6,994,318 B2 | February 2006 | Burke |

8 Claims, 3 Drawing Sheets

U.S. PATENT DOCUMENTS

| | | | | |
|---|---|---|---|---|
| 4,736,890 | A | 4/1988 | Wallington | |
| 4,991,775 | A * | 2/1991 | Huber et al. | 239/25 |
| 5,072,757 | A | 12/1991 | Lin | |
| 5,125,577 | A * | 6/1992 | Frankel | 239/211 |
| 5,165,121 | A | 11/1992 | McTargett et al. | |
| 5,349,987 | A | 9/1994 | Shieh | |
| 5,758,690 | A | 6/1998 | Humpert et al. | |
| 5,833,849 | A | 11/1998 | Primdahl | |
| 5,983,938 | A | 11/1999 | Bowers et al. | |
| 6,085,790 | A | 7/2000 | Humpert et al. | |
| 6,179,130 | B1 | 1/2001 | Nguyen et al. | |
| 6,367,707 | B1 | 4/2002 | Kang | |
| 6,381,770 | B1 | 5/2002 | Raisch | |
| 6,425,149 | B1 | 7/2002 | Wang | |
| 6,431,217 | B2 * | 8/2002 | Robinson | 138/110 |
| 6,457,589 | B1 * | 10/2002 | Poirier et al. | 210/459 |
| 6,648,187 | B1 | 11/2003 | Shypkowski | |
| 6,994,318 | B2 | 2/2006 | Burke | |
| 7,090,144 | B2 * | 8/2006 | Gross et al. | 239/26 |
| 7,611,073 | B2 * | 11/2009 | Crutcher | 239/25 |
| 2006/0207670 | A1 | 9/2006 | Peters | |
| 2007/0175531 | A1 * | 8/2007 | Daniels | 137/801 |
| 2007/0176024 | A1 | 8/2007 | Denzler | |
| 2007/0277891 | A1 * | 12/2007 | Frankel | 137/801 |
| 2008/0196159 | A1 * | 8/2008 | Lee | 4/678 |

* cited by examiner

FLUID DELIVERY EXTENSION SYSTEM

TECHNICAL FIELD

The present invention is directed toward apparatus, methods, and systems for modifying the location of fluid delivery from a standard faucet, spigot, and nozzle combination.

SUMMARY

According to one aspect to the present invention there is provided a system for securing a tube to a spigot and/or nozzle, the system comprising: a moveable-rotatable tube; a tapered washer adapted to facilitate the tube being secured to the spigot while helping to seal the area to fluid flow and openings in the tube such that rotating the tube allows for a selection of exit points for the flow of a fluid (water).

It should be understood that any references herein to a sink, faucet, spigot, or nozzle, may be considered to apply, unless otherwise specified, to any other sink, faucet, spigot, or nozzle, bathing system or cleaning system, etc.

BACKGROUND

Often standard faucet, spigot, nozzle combinations deliver water only to the distal (when viewed from a common standing or used position) portions of a sink, which is a great inconvenience to very small children and their parents. Current remedies to such an age-old problem include the adult placing a stand for the child in front of the sink so said child may be elevated with respect to the sink. Other remedies include manually lifting the child to wash their hands which takes its toll on adults' backs. Placing hoses and flexible extensions on a sink still requires a child to reach and activate the hose, and once activated a flexible hose may take on the function of a toy and the chance of a bathroom spill or flood is increased. Some systems provide for water flume like delivery but must be fastened by unsightly clamps or straps to the spigot. Such systems do not provide for easy delivery of water to multiple locations (for example, adult—close to the rear of the sink, and child—close to the front of the sink. In their attempt to make a sink child-user-friendly, such systems and other remedies, on the shelf and in the prior art, often obliterate the adult functionality of a sink; the adult functionality of a sink is: to deliver water in the rear portion of a sink allowing for larger adult hands and forearms to be washed, to allow space for the placement of washcloths, to locate the cleansing of personal items such as shavers over the drain so as to minimize sticking of toothpaste and stubble-laden-shaving cream on the front edges of a sink therefore minimizing cleaning. Rotating dials attached to the nozzle or spigot retain the water pressure of the zone as they are flow-restrictive at some point, which may include the attachment point; rotating such devices into position is often difficult for small children, and unfortunately, the available pressure may lead to spills from pressurized jets of water. Thus, drawbacks exist in the current existing ways to manage the problem of small children washing in sinks primarily designed for adult usage.

Furthermore comparison exists with the various members of the prior art; and the following differ from the novel device at a minimum by these expressed statements.

The novel device has a standard access hole in the middle of the pipe which rotates 360 degrees and incorporates horizontal walls as opposed to Buxton [U.S. Pat. No. 2,171,023].

Ulleland [U.S. Pat. No. 1,253,309] clips on, incorporates a plug and has a lever. The novel device does not have any of these and freely rotates 360 degrees.

The novel device's design does not incorporate any hidden component such as a hose or a stretchable hose located out of view and within some other component such as Shieh [U.S. Pat. No. 5,349,987]. The novel device is free-flowing and freely rotates 360 degrees to provide different water flows based simply on gravitational position as there is no build-up of pressure within the system.

The novel device does not operate on a control/lever device to restrict the flow of the water such as Wallington [U.S. Pat. No. 4,736,890]. It is free-flowing—dictated by the gravitation of the curved linear extension. There are also no valves and handles.

The novel device does not have a reservoir for detergent or chemicals nor does it rely on a bulbous portion. Additionally, the novel device is vertically oriented and has no containers such as the ones found in Benjamin [U.S. Pat. No. 2,476,079].

Lin [U.S. Pat. No. 5,072,757] is similar to the novel device as it also incorporates a rotational spout. However, Lin's system is internal unlike the external system found on the novel device. Additionally, Lin does not offer a gravitational variability of flow through different holes nor does it extend the spout to provide different lengths of water flow as can be found with the novel device.

Madsen [U.S. Pat. No. 2,507,535] is vertical and integrates multiple seals to restrict water leakage under high-pressure as opposed to the novel device.

The novel device's design does not incorporate any hidden components such as a hose or a stretchable hose located out of view and within some other component such as Humpert [U.S. Pat. No. 5,758,690]. It also freely rotates 360 degrees to provide different water flows based simply on gravitational position as opposed to any build-up of pressure within the system.

The Nguyen [U.S. Pat. No. 6,179,130 B1] Spout Shell and Spout Assembly are elevated in nature and horizontal. The system is capped in the end thus building-up pressure and the un-filtered water aerator and filtered-water nozzle provide differential flows via a dial. Conversely, the novel device provides differential flows and locations, is horizontal and free-flowing.

The novel device is not meant to have a hidden component such as a hose or a stretchable hose located out of view and within some other component. It freely rotates 360 degrees to provide different free-flowing water flows based simply on gravitational position as opposed to Reich [U.S. Pat. No. 6,381,770 B1] which builds-up pressure within the system.

Hoff [U.S. Pat. No. 1,799,815] is vertically oriented with a nozzle/head being the principal goal to deliver fluid. It also acts as a stand. Differentially, the novel device needs no stand as the whole system fits horizontally along the axis of a horizontal spout.

Humpert [U.S. Pat. No. 6,085,790] requires a trigger to trigger the flow, is vertically-oriented, and operates under pressure. The trigger also maintains its position under pressure and the water's pressure is required to maintain trigger position and choice of flow as opposed to the novel device which is free-flowing, low pressure and chosen by rotation.

The novel device is not a reservoir nor does it work under pressure such as Primal [U.S. Pat. No. 5,833,849] a vertically oriented device that requires a control valve to divert the flow into the filter.

The novel device does not mix hot and cold water nor work using ratios. The novel device has no valves, freely rotates 360 degrees and does not allow for variable distance of water flow from the faucet as opposed to Countryman [U.S. Pat. No. 3,765,455].

The Bowers [U.S. Pat. No. 5,983,938] choice of nozzles is not made by axially rotating the device around the spout but by the rotating perimeter flange or cover. Conversely, the novel device does not intend to provide a reservoir, filter location or to mix hot and cold water.

The Denzler [US2007/0176024 A1] jet feature works under pressure and creates perforated plates for water flow. However, the novel device results in non-broken, gasified nor pressurized water.

A smooth curvaceous linear plastic cover is used to make a traditional multi-angulate spout to smoothen the aesthetics of the faucet; moreover, McTargett [U.S. Pat. No. 5,165,121] does not rotate and does not extend for a choice of locations of water flows as opposed to the novel device.

The Kang [U.S. Pat. No. 6,367,707 B1] system uses pressure and exists on a different axis as opposed to the parent spigot. Kang requires spring activation controls and although delivery of water is through two sources, Kang is not controllable by axial rotation. Additionally, Kang obliterates the nozzle area and causes the first water delivery to be forced downward into the sink compared to the novel device. Some sinks are shallow whereupon Kang seem to be disadvantaged.

Hyde [U.S. Pat. No. 2,747,930] is a drinking fountain attachment for a spigot that works with a curved downward pointing nozzle. Hyde acts like a rotatable bucket and is not tubular in shape. Additionally, it does not offer a significant extension of the spigot to facilitate hand washing while the novel device does.

Shypkowski [U.S. Pat. No. 6,648,187 B1] is a series of tubes which are interconnected and uncontrolled by axial rotation that has no ability to control water flow. Additionally, it is non-rigid, comprise of numerous pipes and the initial primary axis is vertical which differs from the novel device.

Weakley [U.S. Pat. No. 3,316,928] is an extension for a drain spout. As typical for drain spouts, they are vertically oriented and thus Weakley is not axially located nor is it axially controllable with respect to the down spout/spigot.

Bozarth [U.S. D288520] differs from the novel device from being a vertically adapted non-controllable series of acute 90 degree bends in a tube. There is no axial controllability and water may only exist in the path of a circle.

Peters [US 2006/0207670 A1] differs by attaching to the end of the spigot at the nozzle. Although Peters extends the range of the spigot it does not do so in a fashion controllable by axial rotation nor does it offer a source of water more proximal than Peters' final nozzle. Peters has to be disconnected in order for the spigot to flow from the original nozzle location.

Wang [U.S. Pat. No. 6,425,149 B1] also differs by attaching the extension to the end of the spigot at the nozzle. Although Wang extends the range of the spigot it does not do so in a fashion controllable by axial rotation but by vertical rotation. Wang requires multiple joints and pivot points nor does it offer a source of water more proximal than Wang's final nozzle. Wang has to be disconnected in order for the spigot to flow from its original nozzle location.

Barks [U.S. Pat. No. 3,638,968] operate under pressure with one final source of exit. Barks' adapter simply appears to be an outer tie compressing a hose against a spigot. Barks only offer water flow in one location and is not axially-controlled as opposed to the novel device which is free flowing, axially controlled and provide water source at a distance from the nozzle and at the spigot nozzle.

Although Daniels [US 2007/0175531 A1] provides water in a free flowing flume-like fashion, Daniels is not controllable by axial rotation nor does Daniels provide multiple quick-choice axially controlled paths of exit for the water. Daniels is bound by hanging straps as opposed to the novel device.

Burke [U.S. Pat. No. 6,994,318 B2] likens to a rotatable bucket. However, Burke's principal purpose is to act as a lever to control the faucet in food industry workers. Burke differs by non-axial control and use of a lever. As well as not having a completely closed tubular shape.

BRIEF DESCRIPTION OF THE DRAWINGS

Understanding that drawings depict only certain preferred embodiments of the invention and are therefore not to be considered limiting of its scope, the preferred embodiments will be described and explained with additional specificity and detail through the use of the accompanying drawings in which.

DETAILED DESCRIPTION OF PREFERRED EMBODIMENTS

In the following description, numerous specific details are provided for a thorough understanding of specific preferred embodiments. However, those skilled in the art will recognize that the invention can be practiced without one or more of the specific details, or with other methods, components, materials, etc.

In some cases, well-known structures, materials, or operations are not shown or described in detail in order to avoid obscuring aspects of the preferred embodiments. Furthermore, the described features, structures, or characteristics may be combined in any suitable manner in one or more embodiments.

Described herein are various embodiments of apparatus, methods, and systems for extending and modifying the location of flow for spigots and nozzles.

Embodiments of the present invention provide a system for securing a positionally controllable tube 4 upon a spigot 2 and nozzle 3 which are in turn connected to a faucet 1.

Figure 1:
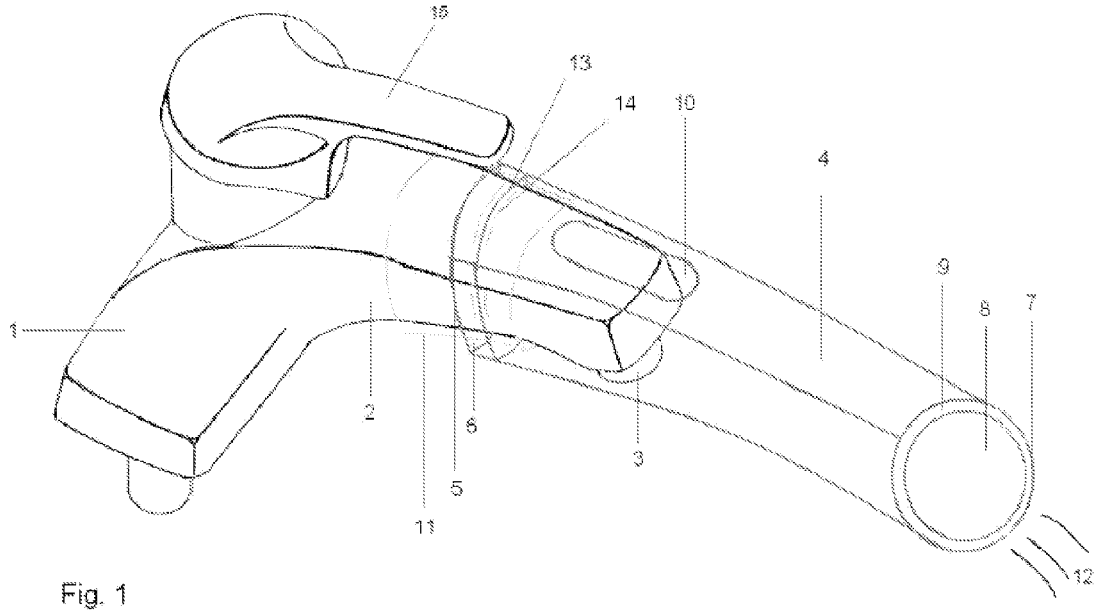
FIG. 1 is a perspective view of an embodiment of the invention in which a spigot and nozzle of a faucet are secured to a controllable tube and tapered washer.

FIG. 1 is a perspective view of an embodiment of the invention in which a spigot 2 and nozzle 3 to a faucet 1 are secured to a rotatable tube 4 and tapered washer 11. A first opening 6 is present at a first end 5 of the tube 4, wherein the first opening 5 is configured to be coupled with a spigot. A second opening 8 exists at a second end 7 of the tube 4 opposite from the first end 5. A third opening 10 is positioned in a wall 9 of the hose between the first and second ends. A connecting means, tapered washer 11 is positioned to couple the first opening 6 with the spigot 2, wherein the tapered washer 11 (comprises flexible wedge, cylinder, wrapper sheet, or band for fastening or sealing), wherein when the tube 4 is coupled with the spigot 2. The tube 4 is configured to be rotatably repositionable between first and second configurations, wherein, in the first configuration, water 12 exits the tube 4 through the second opening 8 and the third opening 10 is directed upward to prevent water from exiting the tube 4 through the third opening 10, and wherein, once the tube 4 has been rotated to the second configuration, the third opening 10 is directed downward such that water 12 exits the hose through the third opening 10.

In some embodiments of the system the rotatable tube may be comprised of flexible or semi-rigid materials including but not limited to: polymers, metals, and plant derived materials. Regarding said polymers, such polymers may include but not necessarily be limited to: plastics, polyvinyl chloride, polyethylene, polyurethane, polypropylene, silicone, polystyrene, polyvinyl butyral, polyacrylonitrile, rubber, polychloroprene, phenol-formaldehyde resin, para-aramid, polyvinylidene fluoride, polyethylene terephthalate, polychloroprene, polyamide, polyacrylonitrile, copolyamid, aromatic polyamide, polytetrafluoroethylene, poly-p-phenylene-2,6-benzobisoxazole. Flexible foamy plastics or materials may also be used to reduce leakage and maintain a seal between the proximal opening (first opening) and the more proximal end of the spigot. Plastic softeners such as phthalates may be added to increase flexibility. Regarding said metals, such metals may include but not necessarily be limited to: aluminum, manganese, chromium, copper, brass, iron, steel, nickel, or stainless steel, or alloy thereof. Regarding said plant-derived materials; such plant-derived materials may include but not necessarily be limited to: paper, papyrus, resins, hemp, wood, leaves, and the like.

In an advantageous embodiment, to suit a spigot with rectangular cross sectional dimension (varying from a distal aspect of 3 cm by 1.5 cm and more proximally 3 cm×2.8 cm and measuring 10 cm in length with a cylindrical inferiorly oriented distal spout measuring 2 cm diameter by 0.8 cm height) a polyvinylchloride tube of 20 cm length and measuring 5 cm outer diameter with a 4 mm wall thickness may be applied. The tube has a slight bend from storage and transportation in a coiled state which is about 5-10 degrees off axis. The proximal opening (first end) may be cut as a circle and the distal end (second end) maybe cut as an oval (when viewed from any angle excepting straight along the axis of the second end). A third opening is made in the wall at a position transverse to the first and second openings. A slot shaped opening, with its axis oriented along the axis of the tube measures 2 cm×4 cm to capacitate outward flow from the spigot nozzle contained within the rotatably applied tube. Rounding the edges of slots and ends may render the aesthetic nature of the embodiment more pleasing. Prior to the tube being attached to the spigot, a tapered washer is applied around the circumference or outside of a selected position on the proximal end of the spigot. The tapered washer for the aforementioned sized spigot and tube is 2 cm wide by cut length of 11 cm with a thickness of wedge varying from 2 mm to 4 mm. The cut length leaves about a 1 cm gap in the ends of the applied washer which is oriented superiorly. The washer may be held in place against the spigot simply by the force of the contracting stretchable polyvinyl chloride of the tube and complimentary invaginations/evaginations. The tube may be rotated in this design by 180 degrees to select flow out of the nozzle via the 3rd opening or slot or rotated 180 degrees to allow the water to flow like a flume out of the second or distal opening, farther away from the faucet and spigot but closer to potential child at the near edge of the sink.

In some embodiments, the dimensions for the length of the tube 4 may vary from 2 cm to 40 cm. In some embodiments, the dimensions for the width of the tube 4 may vary from 1 cm to 10 cm. In some embodiments the dimensions for the wall thickness of the tube may vary from 1 mm to 15 mm. In some embodiments, the dimensions of the first and second openings of the tube 4 may vary from 1 cm to 10 cm.

In some embodiments the third opening may measure up to any dimension less than the diameter or length of the tube; but the most helpful measurements would range about from 1 cm to 3 cm by 1 cm to 8 cm to capacitate outward flow from the spigot nozzle contained within the rotatably applied tube. Rounding the edges of slots and ends may render the aesthetic nature of the embodiment more pleasing. Multiple openings may be made in transverse locations of varying shapes to change the shape of the water flowing when the location is rotatably selected, such as squares, circles, flat slot shapes, etc. Aeration devices, flow rates, alignment between nozzle and third opening, size differential between nozzle and third opening, change of fluid directionality between the nozzle and third opening and turbulence will affect the ability of the water flow to remain collimated and maintain a recognizable shape.

In some embodiments, the geometric cross sectional shape of the tube 4 may vary through various embodiments as may the flexibility of the material the tube 4 is comprised of. The geometric shape of the tube at the first and at the second openings may also vary through various embodiments. However, an advantageous embodiment for such a cross sectional shape is circular; in others, the cross sectional shape is oval.

In other embodiments, the tube may be attached to the spigot without a washer or tapered washer, however unintended leakage may occur at the junction of the first opening (proximal) and the spigot, especially if the spigot is geometric in cross-sectional shape and not oval, ovoid or circular in cross-section.

In yet other embodiments, the tube may be flared (wider) in diameter and thus the diameter throughout the tube may differ. Flaring, or diameter-widening, of the tube may be advantageous at the more proximal location near to the first opening.

In other embodiments, a washer is applied around the circumference or outside of a selected position on the proximal end of the spigot. In an advantageous embodiment a washer would be a material that may create a seal between the spigot, washer and tube, such that the tube may rotate. In other embodiments the washer may have a variety of shapes including flat, round, cylindrical, and geometric. In an advantageous embodiment the washer is flexible or malleable and may be comprised of a metal or a polymer or plant material. Regarding said polymers, such polymers may include but not necessarily be limited to: plastics, polyvinyl chloride, polyethylene, polyurethane, polypropylene, silicone, polystyrene, polyvinyl butyral, polyacrylonitrile, rubber, polychloroprene, phenol-formaldehyde resin, para-aramid, polyvinylidene fluoride, polyethylene terephthalate, polychloroprene, polyamide, polyacrylonitrile, copolyamid, aromatic polyamide, polytetrafluoroethylene, poly-p-phenylene-2,6-benzobisoxazole. Flexible foamy plastics or materials may also be used to reduce leakage and maintain a seal between the proximal opening (first opening) and the more proximal end of the spigot. Plastic softeners such as phthalates may be added to increase flexibility. Regarding said metals, such metals may include but not necessarily be limited to: aluminum, manganese, chromium, copper, brass, iron, steel, nickel, or stainless steel, or alloy thereof. Such metals may be beveled, polished, coated with polymeric compounds or in their native state. Regarding said plant derived materials, such plant derived materials may include but not necessarily be limited to: paper, resins, hemp, wood, leaves, and the like. In other embodiments the washer may not be of a uniform thickness. In an advantageous embodiment, the washer may have a tapered or angular shape.

Regarding the circumference of a spigot, as an example only: if a spigot were cross-sectionally round with a proximal outer diameter of 3 cm then an expected circumference of pi times 3 cm yields a 12.3 cm circumference. This would necessitate a tube choice of about 3 cm inner constant diameter or a proximal flared inner diameter of 3 cm to grip the spigot without a washer. A smaller tube may be chosen depending upon elasticity, for example rubber. However, if only a tube of larger inner diameter is available, the tapered washer offers a wide range of adaptability. A strip of tapered washer measuring in length to 30 cm but vary between 5 cm and 1 meter depending upon manufacturers choice can help to accommodate diameters of tube exceeding the faucet by amounts ranging from 1 mm to 2 cm and greater depending upon the maximum wedge thickness. The width (when viewed from the top) of the strip of potential tapered washer may vary from 1 cm to 4 cm. When viewed as a strip (from the side lengthwise with both ends visible) the tapered washer may vary in thickness from front to back between 1 mm and 2 cm; from the thin end to the thick end the thickness may vary from 1 mm in the front side of the thin end to 2 cm in the back side of the thick end; the strip of tapered washer may also vary from 1 mm in the front side of the thin end to 1 cm in the front side of the thick end; the tapered washer may also vary in thickness from 2-4 mm at the back end of the thin end to 2 cm at the back side of the thick end. Each tapered washer may be custom cut by the customer, or provided in varying lengths by the manufacturer. The washer may be held in place against the spigot by double or single tape, caulk, silicone, glue or the like. Invaginated or evaginated (outer circumferential on positioning) grooves placed width-wise in the washer are intended to match opposing evaginated or invaginated inner circumferential grooves in the tube. Alternatively, invaginated grooves in both washer and tube may be coupled with an O-ring or similar space-occupying material to form a rotatable union between both invaginated grooves in that embodiment. The tapered washer may be provided in fixed sizes or in an advantageous embodiment cut to size from a length of strip varying from thin at one end to thick at its terminus thus providing a wide range of accommodating potential tapered washer sizes. If the tapered washer is cut from a length of material the tapered washer will of course not be continuous once applied. If the washer is discontinuous, or if too little material is cut and a gap exists in the washer edges when wrapped around the spigot, simply orient the gap superiorly and fluid will likely not drain from the area as flow is low pressure and gravitationally influenced. Alternatively, the tapers may be manufactured such that they only taper in the direction of width; for example a segment of tapered washer may be provided that is 10 cm long and 4 cm wide, wherein the front edge is 2 mm and the back edge is 5 mm; another segment of tapered washer may be provided that is 10 cm long 4 cm wide wherein the front edge is 5 mm and the back edge is 10 mm; another segment of tapered washer may be provided that is 10 cm long 4 cm wide wherein the front edge is 10 mm and the back edge is 20 mm. Extrusion manufacture of the product may thus be facilitated but there may delivery of extra unusable product.

Figure 2:
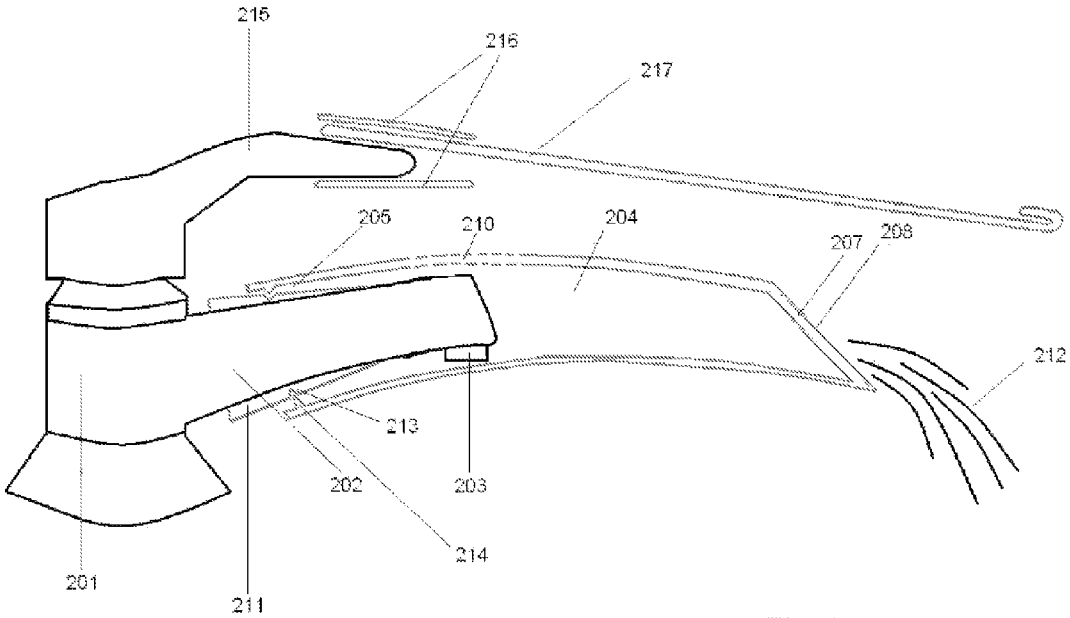
FIG. 2 is a cross-sectional view taken along a vertical axis through the spigot in the first configuration.

FIG. 2 is a cross-sectional view taken along a vertical axis through the spigot in the first configuration. The first configuration will be considered the 'child compatible' version, whereupon flume like stream low pressure water is delivered to the extended second end 207 of tube 204. In this version, third opening 210 is not aligned with nozzle 203 and may preferably be at a position 180 degrees of turning tube 204 away. The distal or second end 207 of tube 204 may be pointed downward if a bent tube 204 is used. The water appears free flowing at the distal end like a waterfall. In a recapitulation of the advantageous embodiment, to suit a spigot 202 with rectangular cross sectional dimension (varying from a distal aspect of 3 cm by 1.5 cm and more proximally 3 cm×2.8 cm and measuring 10 cm in length with a cylindrical inferiorly oriented distal spout measuring 2 cm diameter by 0.8 cm height) a polyvinylchloride tube of 20 cm length and measuring 5 cm outer diameter with a 4 mm wall thickness may be applied. The tube 204 has a slight bend from storage and transportation in a coiled state which is about 5-10 degrees off axis. The proximal opening 205 (first end) may be cut as a circle and the distal end 208 (second end) maybe cut as an oval (when viewed from any angle excepting straight along the axis of the second end). A third opening 210 is made in the wall at a position transverse to the first and second openings. The third opening may be slot shaped 210, with its axis oriented along the axis of the tube measures 2 cm×4 cm to capacitate outward flow from the spigot 202 and nozzle 203 contained within the rotatably applied tube. Rounding the edges of slots and ends may render the aesthetic nature of the embodiment more pleasing. Prior to tube 204 being attached to the spigot, a tapered washer 211 is applied around the circumference or outside of a selected position on the proximal end of the spigot 202. The tapered washer for the aforementioned sized spigot and tube is 2 cm wide by cut length of 11 cm with a thickness of wedge varying from 2 mm to 4 mm. The cut length leaves about a 1 cm gap in the ends of the applied washer which is oriented superiorly. The tapered washer 211 may be held in place against the spigot simply by the force of the contracting stretchable polyvinyl chloride of the tube and complimentary invaginations/evaginations 213 and 214. The tube may be rotated in this design by 180 degrees to select flow out of the nozzle via the third opening or slot or rotated 180 degrees to allow the water 212 to flow like a flume out of the second or distal opening 208, farther away from the faucet 201 or spigot 202 but closer to potential child at the near the edge of the sink.

To assist a child in controlling a distant faucet handle a tapered tube 216 usually different in diameter and size from tube 204 may attach a prefabricated metal or plastic lever 217 to the faucet handle 215 by forcing both the faucet handle 215 and a prefabricated lever 217 into said flexible tube 216 usually measuring 3 cm length by 2 cm in diameter into said tube 216 together to move as a unit. This accessory mechanism may thus extend a difficult to reach faucet handle to within 'reach' for operability by a child. In another embodiment tube 216 is flared, with one opening larger than another. In another embodiment, the prefabricated lever 217 may be straight or bent or malleable or metal or plastic, or in the form of a strap or stick. The lever 217, tube 216, handle 215 combination may extend reach of operability to a child. In another embodiment, the lever edges are rounded for safety.

Figure 3:
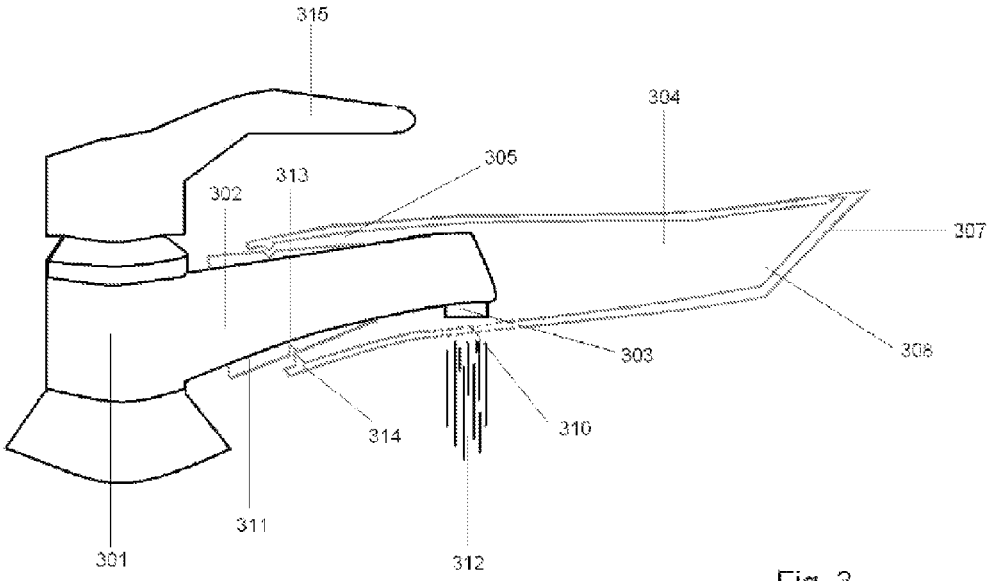
FIG. 3 is a cross-sectional view taken along a vertical axis through the spigot in the second configuration.

FIG. 3 is a cross-sectional view taken along a vertical axis through the spigot in the second configuration. The first configuration will be considered the 'adult compatible' version, whereupon no water is delivered to the extended second end 307 of tube 304. In this version, third opening 310 is aligned with nozzle 303 by rotating tube 304 into position. The distal or second end 307 of tube 304 may be pointed up if a bent tube 304 is used; this facilitates adult hand placement beneath the aligned nozzle 303 and third opening 310 to receive water 312 similar in quality to nozzle 303 only. If the nozzle contains an aerator, the flowing water quality will be aerated. In a recapitulation of the advantageous embodiment, to suit a spigot 302 with rectangular cross sectional dimension (varying from a distal aspect of 3 cm by 1.5 cm and more proximally 3 cm×2.8 cm and measuring 10 cm in length with a cylindrical inferiorly oriented distal spout measuring 2 cm diameter by 0.8 cm height) a polyvinylchloride tube of 20 cm length and measuring 5 cm outer diameter with a 4 mm wall thickness may be applied. The tube 304 has a slight bend from storage and transportation in a coiled state which is about 5-10 degrees off axis. The proximal opening 305 (first end) may be cut as a circle and the distal end 307 (second end) maybe cut as an oval (when viewed from any angle excepting straight along the axis of the second end). A third opening 310 is made in the wall at a position transverse to the first and second openings. A slot shaped opening 310, with its axis oriented along the axis of the tube measures 2 cm×4 cm to capacitate outward flow from the spigot 302 and nozzle 303 contained within the rotatably applied tube. Prior to tube 304 being attached to the spigot, a tapered washer 311 is applied around the circumference or outside of a selected position on the proximal end of the spigot 302. The tapered washer for the aforementioned sized spigot and tube is 2 cm wide by cut length of 11 cm with a thickness of wedge varying from 2 mm to 4 mm. The cut length leaves about a 1 cm gap in the ends of the applied washer which is oriented superiorly. The tapered washer 311 may be held in place against the spigot simply by the force of the contracting stretchable polyvinyl chloride of the tube and complimentary invaginations/evaginations 313 and 314. Again, tube 304 may be rotated in this design by 180 degrees to select flow out of the nozzle via the third opening or slot or rotated 180 degrees to allow the water 312 to flow like a flume out of the second or distal opening 308, farther away from the faucet 301 or spigot 302 but closer to potential child at the near the edge of the sink.

Figure 4A:
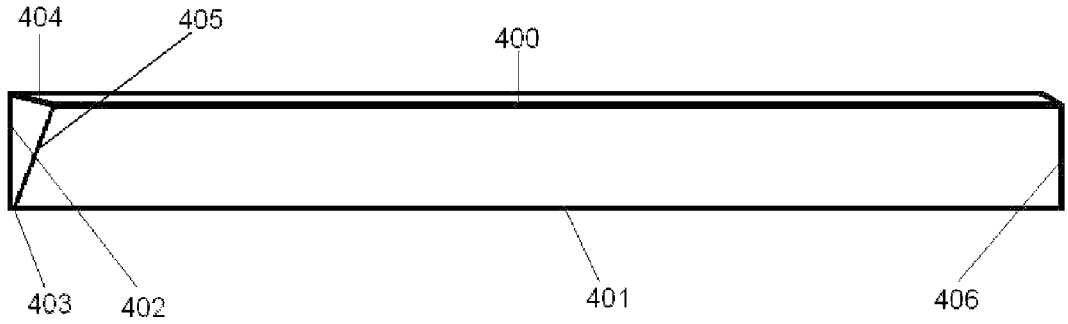
FIGS. 4A-C depicts cross-sectional views of embodiments of tapered washers.
Figure 4B:
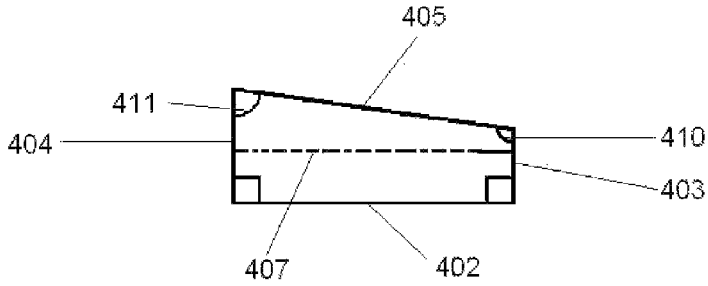
Figure 4C:
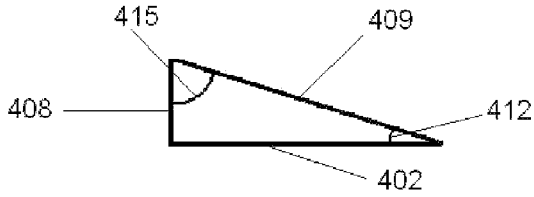

FIGS. 4A-C depicts cross-sectional views of various other embodiments of the invention that includes the tapered washer.

FIG. 4A is a top cross sectional view of an embodiment of the invention depicting the tapered washer laid out flat. Long sides of the tapered washer 400 and 401 are shown in the untrimmed or uncut state, and in an advantageous embodiment may measure 1 cm to 20 cm, however, a manufacturer may find it practical to manufacture 400 and 401 at lengths between 0.5 cm and 100 cm; short sides of the tapered washer 402 and 406 are also shown in the untrimmed or uncut state, and in an advantageous embodiment may measure 0.5 cm to 4 cm, however, a manufacturer may find it practical to manufacture 402 and 412 at lengths between 0.5 cm and 20 cm. 403 is the anterior edge of the tapered washer and in an advantageous embodiment may measure from 1 mm to 2 mm, however, a manufacturer may find it practical to manufacture 403 at thicknesses between 0.001 cm and 2 cm. 404 is the back edge of the tapered washer and in an advantageous embodiment may measure from 1 mm to 20 mm, however, a manufacturer may find it practical to manufacture 404 at thicknesses between 0.001 cm and 10 cm. Edge 405 is an edge hypotenuse determined by the measurements of 402, 403, and 404 provided that the base angles are as described in 4B.

FIG. 4B is a side cross-sectional view of the embodiment of FIG. 4A. The 'short side' (side previously referred to as the 'short side' in top viewed FIG. 4A even though it is not the shortest line shown here) of the tapered washer is shown as base line 402, and in an advantageous embodiment may measure 0.5 cm to 4 cm, however, a manufacturer may find it practical to manufacture base 402 at lengths between 0.5 cm and 20 cm. 403 is the anterior edge of the tapered washer and in an advantageous embodiment may measure from 1 mm to 2 mm, however, a manufacturer may find it practical to manufacture 403 at thicknesses between 0.001 cm and 2 cm. 404 is the back edge of the tapered washer and in an advantageous embodiment may measure from 1 mm to 20 mm, however, a manufacturer may find it practical to manufacture 404 at thicknesses between 0.001 cm and 10 cm. Edge 405 is an edge hypotenuse determined by the measurements of 402, 403, and 404 provided the base angles between 404 and 402 are right angles and provided the base angles between 402 and 403 are right angles. 407 represents a reference line only at the intersection of sides 405 and 403 (or originating at the top of 403); line 407 proceeds to side 404 and intersects perpendicularly at a right angle. The angle alpha 410 is created between lines (or sides) 405 and 403. The angle beta 411 is created between lines (or sides) 404 and 405. In an advantageous embodiment, alpha 410 is less than 20 degrees and beta 411 exceeds 70 degrees. However other embodiments may exist wherein alpha and beta range from 1 to 89 degrees. In yet other embodiments, no right angles may exist and virtually angle is possible.

FIG. 4C is a side cross-sectional view of another embodiment of FIG. 4A wherein the anterior edge of a tapered washer approaches nil. The 'short side' (side previously referred to as the 'short side' in top viewed FIG. 4A even though it is not the shortest line shown here) of the tapered washer is shown as base line 402, and in an advantageous embodiment may measure 0.5 cm to 4 cm, however, a manufacturer may find it practical to manufacture base 402 at lengths between 0.5 cm and 20 cm. 408 is the back edge of the tapered washer and in an advantageous embodiment may measure from 0.5 mm to 20 mm, however, a manufacturer may find it practical to manufacture 408 at thicknesses between 0.01 mm and 10 cm. Edge 409 is an edge hypotenuse determined by the measurements of 402 and 408 provided the base angle between 408 and 402 is a right angle. The angle gamma 412 is created between lines (or sides) 409 and 402. The angle delta 415 is created between lines (or sides) 408 and 409. In an advantageous embodiment, gamma 412 is less than 20 degrees and delta 415 exceeds 70 degrees. However other embodiments may exist wherein gamma and delta range from 1 to 89 degrees. In yet other embodiments, no right angles may exist and virtually any angle is possible.

In another embodiment, a tapered washer may have an adhesive or glue applied to a side that may attach to the spigot. Such glues may be attached to the tapered washer at the manufacturer with a non-stick backing to preserve freshness and prevent unintended attachment. Other glues, singularly, or as attached to double stick tapes may be supplied to the customer to be placed on a tapered washer.

Alternatively, the customer may bypass the use of a tapered washer, possibly with less durability, greater leakage potential, and less ease of adjustment by wrapping polymer-based tape, for example only, electric tape, or packing tape over the spigot in the area where the first opening of the tube would meet the spigot. Tape may mimic a tapered washer by concentrically wrapping the tape around the spigot progressively more proximally such that thinner compound layers of tape are present distally (toward the nozzle end).

In some embodiments both ends of a tapered washer may be stretched or interlocked by male and female adaptors or by a series of singular projections like dimples in an invaginated or evaginated state. Alternatively the securing member may be adapted to encircle the spigot. It should be appreciated that the flexibility of the securing member enables spigots of different widths to be accommodated and if the interlocking portions of the securing member are adjustable, for example by providing a number of holes to enable the position of the projecting members to fit selected hole or by providing another fastening mechanism, for example, spring metal clip; the ends of the washer may be joined at other positions accommodating spigots of different sizes.

The above description fully discloses the invention including advantageous or preferred embodiments thereof. Without further elaboration, it is believed that one skilled in the art can use the preceding description to utilize the invention to its fullest extent. Therefore, the examples and embodiments disclosed herein are to be construed as merely illustrative and not a limitation of the scope of the present invention in any way.

It will be obvious to those having skill in the art that many changes may be made to the details of the above-described embodiments without departing from the underlying principles of the invention. The scope of the present invention should, therefore, be determined only by the following claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in any country.

The invention claimed is:

1. A hose for coupling with a spigot, comprising:

a first opening at a first end of the hose, wherein the first opening is configured to be coupled with a spigot;

a second opening at a second end of the hose opposite from the first end;

a third opening positioned in a wall of the hose between the first and second ends; and a connecting means for coupling the first opening with the spigot, wherein the connecting means comprises a washer comprising a tapered washer that varies in thickness along at least a portion of the length of the tapered washer, wherein the tapered washer is configured to be positioned around the spigot and be coupled to the hose such that the hose can rotate with respect to the tapered washer and the spigot, wherein when the hose is coupled with the spigot, the hose is configured to be rotatably repositionable between first and second configurations, wherein, in the first configuration, water exits the hose through the second opening and the third opening is directed upward to prevent water from exiting the hose through the third opening, wherein, once the hose has been rotated to the second configuration, the third opening is directed downward such that water exits the hose through the third opening, and wherein the hose is configured such that both the second and third openings rotate together when the hose is rotated between the first and second configurations.

2. The hose of claim 1 wherein the connecting means is configured to facilitate the rotation of the hose.

3. The hose of claim 1 wherein the connecting means facilitates sealing the hose to prevent fluid leakage.

4. The hose of claim 1, wherein the washer comprises at least one of a metal and polymer.

5. The hose of claim 4, wherein said polymer comprises at least one of polyvinyl chloride, polyethylene, polyurethane, polypropylene, silicone, polystyrene, polyvinyl butyral, polyacrylonitrile, polychloroprene, phenol-formaldehyde resin, para-aramid, polyvinylidene fluoride, polyethylene terephthalate, polyamide, polyacrylonitrile, rubber, copolyamid, aromatic polyamide, polytetrafluoroethylene, and poly-p-phenylene-2,6-benzobisoxazole.

6. The hose of claim 4, wherein the metal comprises at least one of aluminum, manganese, chromium, copper, brass, iron, nickel, steel, stainless steel, and an alloy of any of the foregoing.

7. The hose of claim 1, wherein the connecting means comprises at least one of a metal, polymer, and plant matter.

8. The hose of claim 7, wherein said plant matter comprises at least one of paper, papyrus, wood, hemp, resins, and wood.

* * * * *